US007506777B2

(12) United States Patent
Ramp et al.

(10) Patent No.: US 7,506,777 B2
(45) Date of Patent: Mar. 24, 2009

(54) CLOSABLE CONTAINMENT BERM WALL SUPPORT

(75) Inventors: Gregory D. Ramp, Boise, ID (US); Michael O. McCrosky, Boise, ID (US); Dennis M. Hill, Gig Harbor, WA (US)

(73) Assignee: Argonaut Inflatable Research and Engineering, Inc., Meridan, ID (US)

( * ) Notice: Subject to any disclaimer, the term of this patent is extended or adjusted under 35 U.S.C. 154(b) by 341 days.

(21) Appl. No.: 11/644,390

(22) Filed: Dec. 21, 2006

(65) Prior Publication Data

US 2008/0152431 A1 Jun. 26, 2008

(51) Int. Cl.
*B65D 1/37* (2006.01)

(52) U.S. Cl. ..... 220/9.4; 405/112

(58) Field of Classification Search ..... 405/110, 405/112; 220/9.1, 9.4, 9.2, 9.3
See application file for complete search history.

(56) References Cited

U.S. PATENT DOCUMENTS 5,762,233 A * 6/1998 Van Romer ..... 220/9.1
6,092,686 A 7/2000 Shaw
6,880,720 B2 4/2005 Van Romer
6,880,721 B1 4/2005 Barrett
2003/0029873 A1 2/2003 Moffat

* cited by examiner

*Primary Examiner*—John Kreck
(74) *Attorney, Agent, or Firm*—Charles R. Clark

(57) ABSTRACT

A plurality of closable and removable containment berm wall supports are preferably each made from three flexible coated fabric layers and preferably each wall support incorporates three reinforcing members and incorporates a closure means that selectively can close the support into a closed triangular frame. Each berm wall support is designed to cooperate with a sleeve attached to a flexible sidewall of a containment berm unit and when the wall support is in a closed condition to hold the sidewall in an erected condition and when the wall support is in an open condition to allow the sidewall to assume a let down condition. The let down condition allows a wheeled vehicle or other object to conveniently transit over the wall for placement on a floor of the containment berm unit within the perimeter established by the sidewall.

15 Claims, 4 Drawing Sheets

CLOSABLE CONTAINMENT BERM WALL SUPPORT

BACKGROUND OF THE INVENTION

In modern society, efforts are ongoing to prevent or lessen environmental impacts resulting from leaking of petroleum products and other chemicals into the environment. Efforts are made by petroleum industry workers, chemical industry workers, transportation industry workers, military personnel, governmental workers, and other workers involved in liquid containment to guard against environmental contamination resulting from undesired release into the environment of various liquids and chemicals. Various portable containment berm units and systems have been developed as tools in the ongoing efforts by society to contain liquids and other flowable materials. Many containment berm units are constructed from petroleum and chemically resistant flexible coated fabrics including polyester yarn fabrics coated with polyurethane or polyvinyl chloride or other suitable coating material and many of these containment berm units have flexible sidewalls held in an erect condition by sidewall supports with the sidewall supports retained in sidewall support sleeves.

An object of the present invention is to provide an easily removable closable containment berm wall support that is more convenient and easier to use and that makes a containment berm unit having at least one flexible sidewall and the sidewall having a sidewall support sleeve for receiving and retaining a wall support more secure than the containment berm unit would be if equipped with prior art open ended wall support members.

Preferably, a plurality of removable closable berm wall supports are used to selectively hold a flexible berm sidewall in an erected condition or selectively let the sidewall down to a let down condition. The invention allows easy removal and replacement of damaged wall supports.

Another object of the invention is to provide a plurality of containment berm wall supports that can be quickly opened flat to permit a sidewall to be lowered to a let down condition and then quickly folded and closed to raise and hold the sidewall in an erect condition.

The present invention relates to a novel containment berm wall support that improves the utility of a portable containment berm used to contain liquids and chemicals and that helps protect against release of the liquids and chemicals into the environment.

BRIEF SUMMARY OF THE INVENTION

A principal objective of this invention is to help a person who uses a flexible portable containment berm unit to place more easily the containment berm unit in an erected condition; selectively to maintain the unit in the erected condition; selectively to let down a sidewall, sidewalls, or portions of sidewalls of the containment berm unit; and to selectively reestablish the erected condition. The invention is a novel removable closable containment berm wall support designed to improve the utility of a containment berm unit and thus help lessen the likelihood of environmental contamination by liquids and chemicals contained within the containment berm unit.

When open, the berm wall support has a generally long and flat shape. When folded and then closed, the berm wall support forms a closed triangular frame. When used, the wall support is removably and securely attached to the sidewall of the containment berm unit.

Preferably and optimally, a plurality of containment berm wall supports are removably attached to a flexible sidewall of a containment berm unit to support and hold the sidewall in a desired position.

The wall support may be sized in a range of sizes to accommodate the various sizes and dimensions of containment berm units having sidewalls of various sizes and dimensions in use in our society.

The wall support is preferably made with flexible coated fabric layers joined around three generally rigid and generally rod shaped reinforcing members.

A further object of the invention is making available to users a berm wall support that is durable, easy to use, easy to secure to a sidewall, is inexpensive to manufacture, and is easy to replace.

Additional and various other objects and advantages attained by the invention will become more apparent as the specification is read and the accompanying figures are reviewed.

DETAILED DESCRIPTION OF THE INVENTION

Figure 1A:
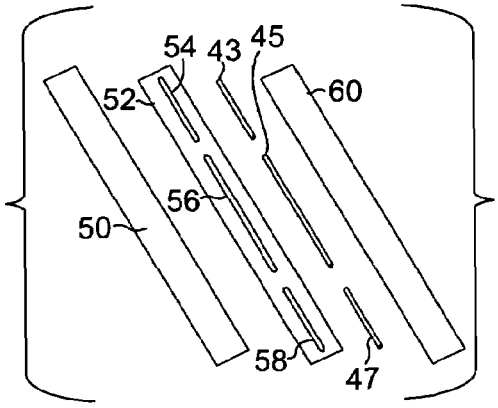
PRIOR ART FIG. 1a
FIG. 1*a* is an exploded perspective view of a prior art berm open ended wall support.
Figure 1B:
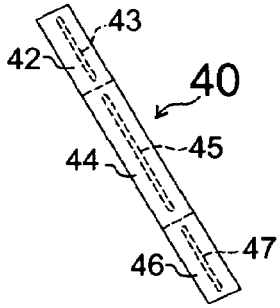
PRIOR ART FIG. 1b
FIG. 1*b* is a perspective view of the prior art berm open ended wall support (shown in FIG. 1*a*) having a first free end and a second free end.
Figure 1C:
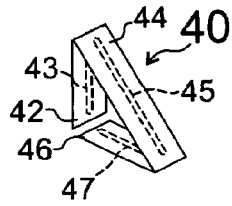
PRIOR ART FIG. 1c
FIG. 1*c* is a perspective view of the prior art berm open ended wall support shown in FIGS. 1*a* and 1*b* and showing the first free end and the second free end in close proximity.
Figure 1D:
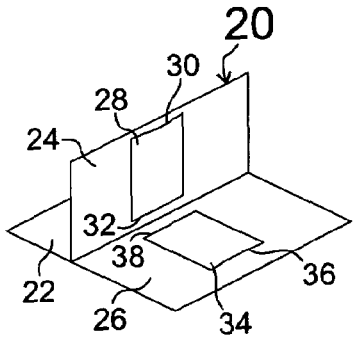
PRIOR ART FIG. 1d
FIG. 1*d* is a partial perspective view of a portion of a prior art containment berm unit showing a sidewall having a sidewall support sleeve and showing a skirt having a skirt sleeve (the prior art berm open ended wall support not shown)
Figure 1E:
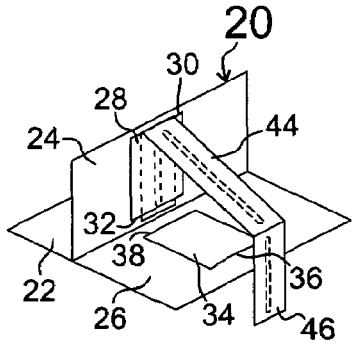
PRIOR ART FIG. 1e
FIG. 1*e* is a partial perspective view of a portion of a prior art containment berm unit shown in FIG. 1*d* showing the first free end of the prior art berm open ended wall support inserted in the sidewall support sleeve.
Figure 1F:
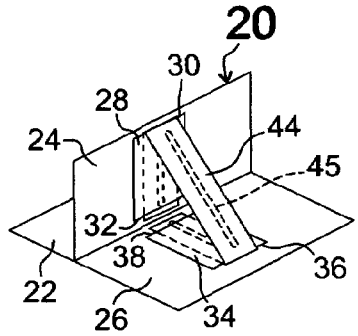
PRIOR ART FIG. 1f
FIG. 1*f* is a partial perspective view of a portion of a prior art containment berm unit shown in FIG. 1*e* showing the first free end of the prior art berm open ended wall support inserted in the sidewall support sleeve and the second free end of the prior art berm open ended wall support inserted in the skirt sleeve.
Figure 2:
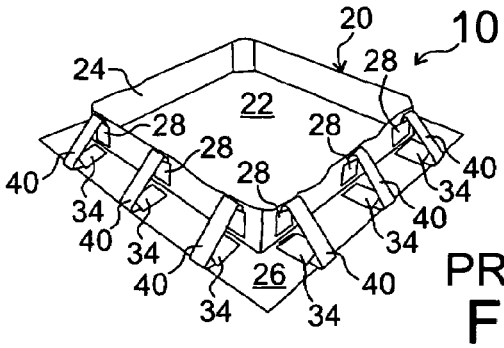
PRIOR ART FIG. 2
FIG. 2 is a perspective view of a prior art containment berm unit shown in an erected condition and showing a plurality of prior art berm open ended wall supports inserted and retained in a plurality of cooperating pairs of sidewall support sleeves and respective skirt sleeves.

Prior art as shown in FIGS. 1*a* to 2, teaches a containment berm unit 10 comprising a flexible liner 20 having a floor 22, the floor peripherally surrounded and connected to at least one berm sidewall 24, a berm sidewall skirt 26 attached to the outer portion of the liner with a plurality of berm sidewall support sleeves 28 attached to exterior portions of the sidewall, each sidewall support sleeve having an upper opening 30 and a lower opening 32, a plurality of berm sidewall skirt sleeves 34 attached to the skirt in cooperating relationship to the plurality of berm sidewall support sleeves, each skirt sleeve having an outer opening 36 and an inner opening 38, and a plurality of berm support members 40 received in the upper openings and the outer openings and retained in the sleeves.

Each prior art open ended berm support member 40 has a first section 42 having a first section reinforcing member 43; the first section pivotally connected to a middle section 44 having a middle section reinforcing member 45; and the middle section pivotally connected to a second section 46 having a second section reinforcing member 47.

Each prior art open ended support member 40 can be made by securing a first flat layer member 50 to an opposing intermediate flat layer 52 having three open reinforcing member registration windows 54, 56, and 58 with the registration windows in serial sequence; by registering the reinforcing members 43, 45, and 47 each respectively in position within one of the respective windows; and by securing the intermediate flat layer to an opposing second flat layer 60 about the reinforcing members.

Referring to FIGS. 3 through 14, the present invention is a novel improved removable closable containment berm wall support 70, 170, 270, or 370.

Each berm wall support 70 of the preferred embodiment has a first flat outer stay layer 72 having a main portion 74 with the main portion connected to a flap portion 76; the first flat outer stay layer is secured to an opposing flat intermediate stay layer 78; the flat intermediate stay layer is sized to generally overlay the main portion; the flat intermediate stay layer having a first leg portion registration window 80, a second leg portion registration window 82, and a third leg portion registration window 84; a first leg portion reinforcing member 86 registered in the first leg portion registration window; a second leg portion reinforcing member 88 registered in the second leg portion registration window; and a third leg portion reinforcing member 90 registered in the third leg portion registration window; the flat intermediate stay layer secured to an opposing second flat outer stay layer 92 about the reinforcing members; and at least one closure means. Each closure means has a first closure element selectively engaging a second closure element. In the preferred embodiment of the wall support 70, the first closure element is a snap button socket 94 and the second closure element is a snap button stud 98.

The preferred embodiment of the containment berm wall support 70 has a first flat outer stay layer 72 having a main portion 74 connected to a flap portion 76; the main portion underlaying in facing opposing relationship a flat intermediate stay layer 78 and secured by a joining means to the intermediate stay layer; the intermediate stay layer having a first leg portion registration window 80 located near one end, having a second leg portion registration window 82 located near its midpoint, and having a third leg portion registration window 84 located near the other end; the flap portion extending beyond said overlaying intermediate stay layer and said flap portion having at least one first closure element (a snap button socket 94) attached to the flap portion near its outward end on the flap portion surface adjacent said intermediate stay layer; a first leg portion reinforcing member 86 registered in the first leg portion registration window; a second leg portion reinforcing member 88 registered in the second leg portion registration window; a third leg portion reinforcing member 90 registered in the third leg portion registration window; a second flat outer stay layer 92 overlaying in facing opposing relationship the intermediate stay layer and overlaying the reinforcing members and secured by a joining means to the intermediate stay layer; and at least one second closure element (a snap button stud 98) attached to the main portion on the main portion surface away from the intermediate stay layer and located near the end of the main portion away from the flap portion.

Joining means include radio frequency welding, heat fusing, ultrasonic welding, gluing with an adhesive, or another suitable method of joining known in the art.

Figure 3:
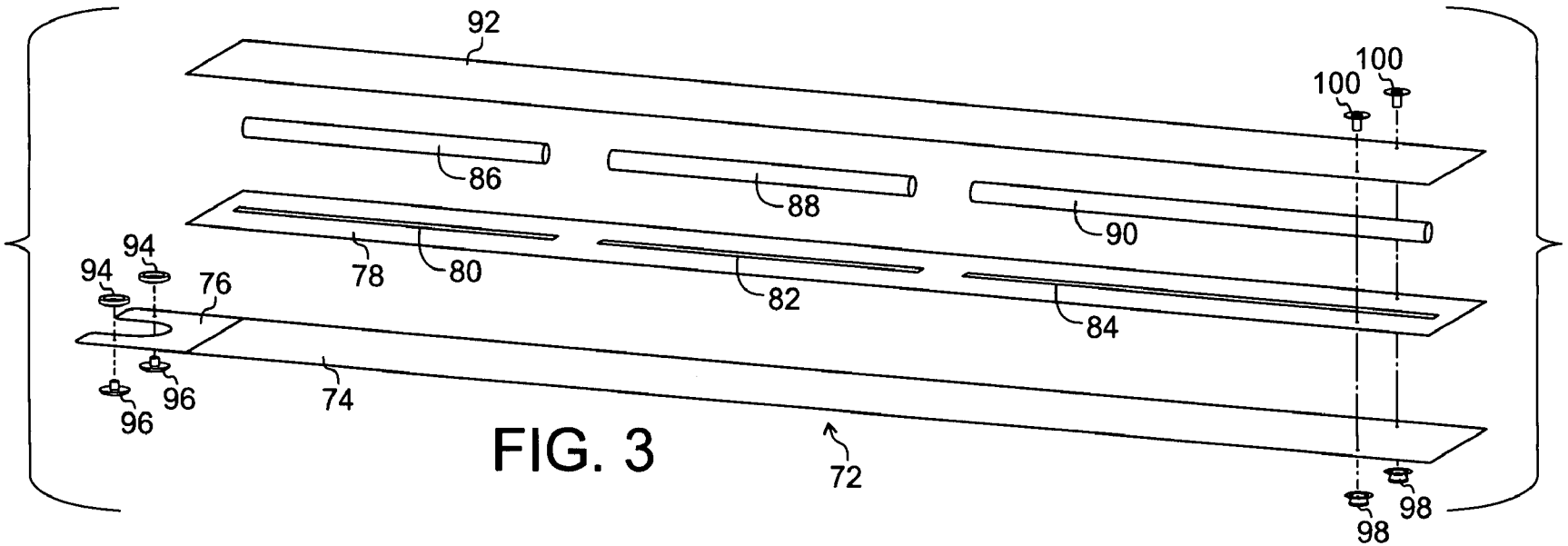
FIG. 3 is an exploded perspective view of a containment berm wall support showing the preferred embodiment.
Figure 4:
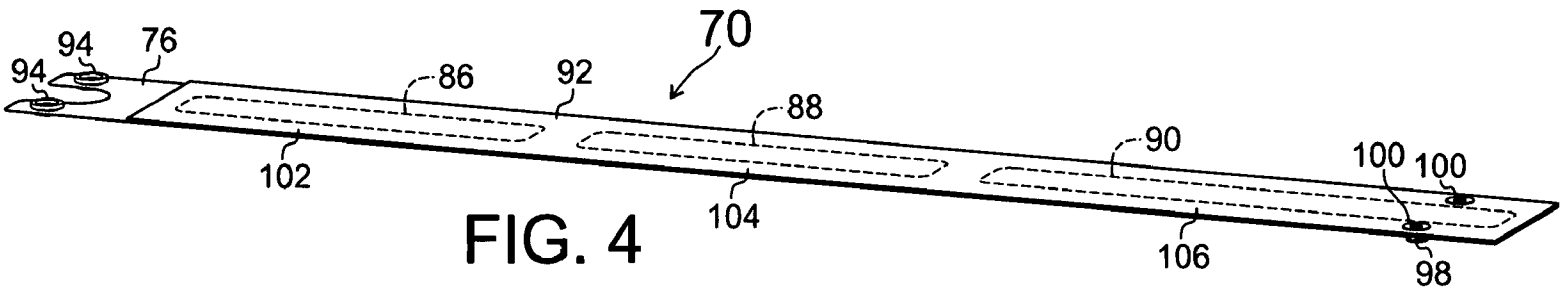
FIG. 4 is a perspective view of the containment berm wall support shown in FIG. 3 in an open extended condition.

FIGS. 3 and 4 best show the preferred embodiment of the containment berm wall support 70. Preferably, the snap button socket 94 is attached to the flap portion 76 by a pressing together of the socket in a manner well known in the art with a cooperating snap button cap 96 mounted in a transverse bore through the flap portion. Preferably, the snap button stud 98 is attached to the main portion 74 by a pressing together of the stud in a manner well known in the art with a cooperating snap button post 100 mounted in a transverse bore through the three layers of the berm wall support and located near the end of the main portion away from the flap portion.

FIG. 4 shows a berm wall support 70 having a flap portion 76 connected to a first leg portion 102 having a first leg portion reinforcing member 86, the first leg portion pivotally connected to a second leg portion 104 having a second leg portion reinforcing member 88, and the second leg portion pivotally connected to a third leg portion 106 having a third leg portion reinforcing member 90.

Figure 9:
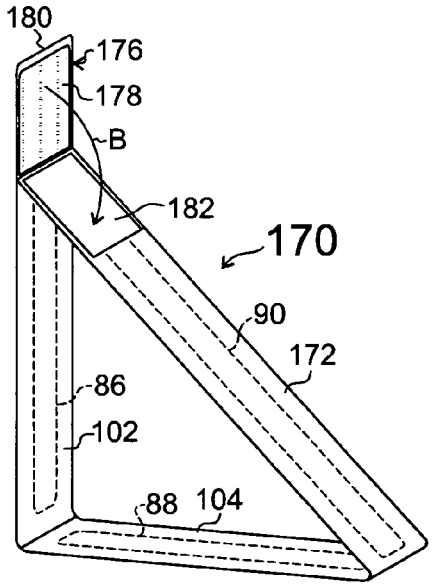
FIG. 9 is a perspective view of a containment berm wall support showing a second embodiment of a containment berm wall support in a transitional condition between an open extended condition and a closed condition and with a curved arrow B illustrating a direction in which a fold may be made in an alternative flap portion of the berm wall support to bring a hook pad attached to the alternative flap portion for engaging with a cooperating loop pad attached near the opposite end of the berm wall support.

FIG. 9 shows a second embodiment of a closable containment berm wall support 170 that incorporates a hook and loop closure as a closure means to selectively close the berm wall support in place of the snap button closure of the preferred embodiment. FIG. 9 shows the wall support 170 having a first alternative first flat outer stay layer 172 having a main portion 74 connected to an alternative flap portion 176, an alternative first closure element (a hook pad 178 of a hook and loop closure) is attached to the flap portion 176 in place of a snap button socket 94, an alternative second closure element (a cooperating loop pad 182 of the hook and loop closure) is attached to the main portion 74 surface away from the intermediate stay layer 78 and located near the end of the main portion away from the flap portion 176 in place of a snap button stud 98. As shown in FIG. 9, the alternative flap portion 176 may have a flap gripping portion 180 that extends beyond the hook pad 178 to provide a user with a gripping portion of the flap that can be gripped by the user during opening and closing of the hook and loop closure.

Figure 10:
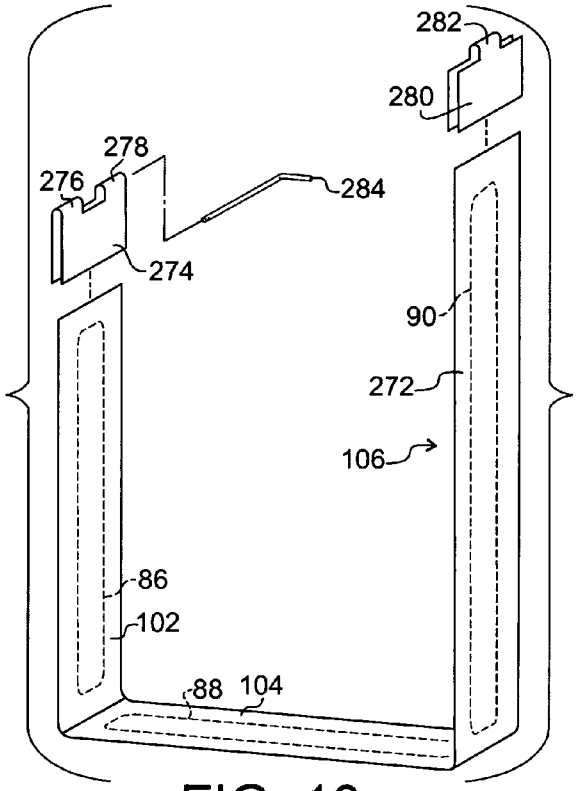
FIG. 10 is an exploded perspective view of a containment berm wall support showing a third embodiment.

FIG. 10 shows a third embodiment of a closable containment berm wall support 270 that in place of the snap button closure of the preferred embodiment incorporates cooperating closed loop endpieces attached to or formed in each end of a main assembly of the containment berm wall support that may be selectively closed together by a closing pin or a closing cable.

FIG. 10 shows a third embodiment of the closable containment berm wall support 270 having a second alternative first flat outer stay layer 272 in place of the first flat outer stay layer 72 of the preferred embodiment. The third embodiment of the closable containment berm wall support 270 having a main assembly having two ends and said main assembly comprising a first outer stay layer 272 underlaying in facing opposing relationship an intermediate stay layer and secured by a joining means to said intermediate stay layer, said intermediate stay layer having a first leg portion registration window located near one end, having a second leg portion registration window located near its midpoint, and having a third leg portion registration window located near the other end; a first leg portion reinforcing member registered in said first leg portion registration window; a second leg portion reinforcing member registered in said second leg portion registration window; a third leg portion reinforcing member registered in said third leg portion registration window; and a second outer stay layer overlaying in facing opposing relationship said intermediate stay layer and overlaying said reinforcing members and secured by said joining means to said intermediate stay layer; a first leg portion female endpiece 274, said female endpiece attached to one end of said main assembly, said female endpiece having a first closed loop portion 276 and a second closed loop portion 278 coaxial to and spaced from one another; and a cooperating third leg portion male endpiece 280, said male endpiece attached to the other end of said main assembly, said male endpiece having a male closed loop portion 282 sized to be received coaxially between said first closed loop portion and said second closed loop portion; and a closing pin 284 for securing said male closed loop portion in position between said first closed loop portion and said second closed loop portion, said closing pin removably receivable and retainable in said loop portions when said loop portions are coaxially aligned with said male closed loop portion between said first closed loop portion and said second closed loop portion.

The third embodiment of the closable containment berm wall support 270 has a first leg portion female endpiece 274 attached to a free end of the first leg portion 102, the female endpiece having a first closed loop portion 276 and a coaxial second closed loop portion 278 spaced one from the other and with the longitudinal axis of the closed loop portions aligned transversely across the free end of the first leg portion; a cooperating third leg portion male endpiece 280 attached to a free end of the third leg portion 106, the male endpiece having a male closed loop portion 282 aligned transversely across the free end of the third leg portion and sized to be received coaxially between the closed loop portions 276 and 278, and a closing pin 284 or a closing cable 292 sized to be selectively received and retained coaxially in and through the closed loop portions 276, 282, and 278 to close the berm wall support.

Figure 11:
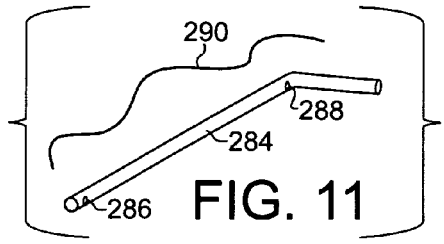
FIG. 11 is an exploded perspective view of a closing pin and a pin securing element.

As shown in FIG. 11, the closing pin 284 can have a first transverse closing pin securement bore 286 near one end and a second transverse closing pin securement bore 288 near the other end sized to receive and retain a pin securing member 290 to secure the closing pin within the closed loop portions when in place within the closed loop portions. The pin securing member 290 can be a wire, a plastic quick tie or a suitable length of cordage.

Figure 12:
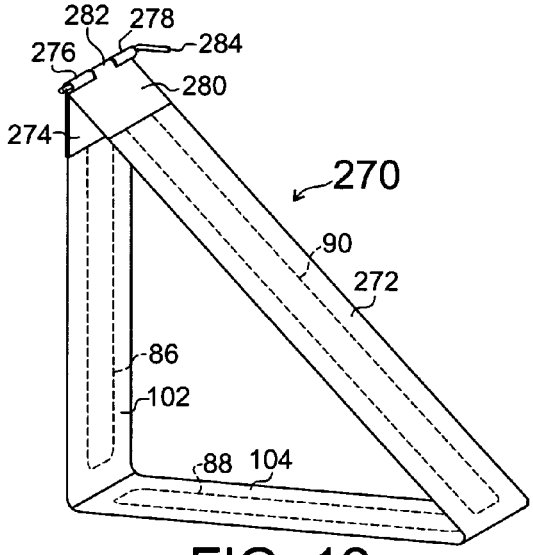
FIG. 12 is a perspective view of the third embodiment of the containment berm wall support shown in FIG. 10 in a closed condition.

FIG. 12 shows a closing pin 284 inserted into and retained in the closed loop portions 276, 278, and 282 thereby closing the berm wall support 270.

Figure 13:
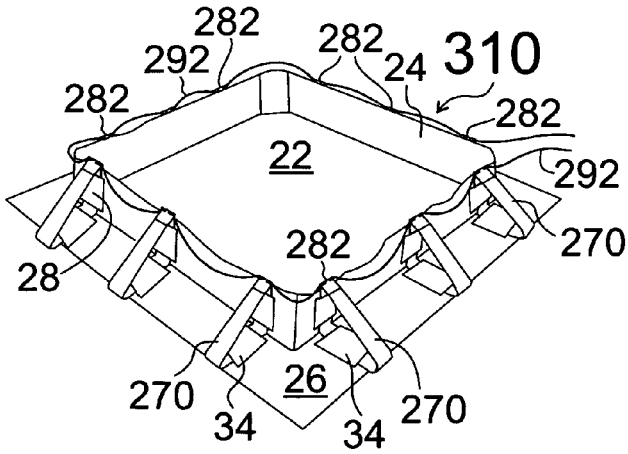
FIG. 13 is a perspective view of a containment berm unit shown in an erected condition and showing a plurality of the third embodiment of the containment berm wall supports inserted, closed, and retained in a plurality of cooperating pairs of sidewall support sleeves and respective skirt sleeves.

As shown in FIG. 13, a flexible closing cable 292 can be substituted for the closing pin 284 to serially close a plurality of berm wall supports 270 to hold erect a sidewall 24 of a containment berm unit 310. The free ends of the closing cable 292 shown in FIG. 13 can be secured one to another to make the containment berm unit 310 more secure by tying the free ends together or by using a lock mechanism known in the art to selectively lock the free ends together. The flexible closing cable 292 can be a wire cable, a nylon rope, a plastic rope, or a length of cordage made from another suitable material.

Figure 14:
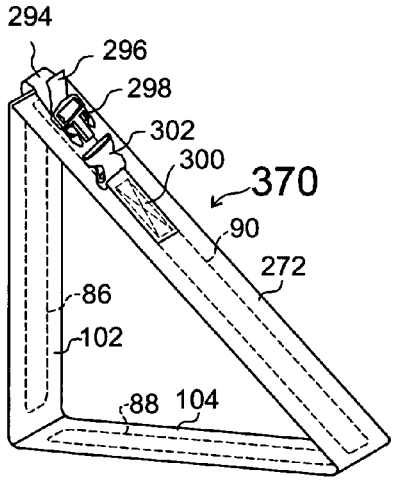
FIG. 14 is a perspective view of a containment berm wall support showing a fourth embodiment of a containment berm wall support having a side release buckle in a transitional condition between an open extended condition and a closed condition.

FIG. 14 shows a fourth embodiment of a closable containment berm wall support 370 that incorporates at least one commonly known side release buckle in place of the snap button closure of the preferred embodiment. FIG. 14 shows the fourth embodiment 370 having a second alternative first flat outer stay layer 272 in place of the first flat outer stay layer 72 of the preferred embodiment and further comprises a first strap member 294 attached to the first leg portion 102 near its free end, the first strap member having a free strap end 296, a side release probe 298 is adjustably threaded onto the first strap member, a second strap member 300 is attached to a side release receiver 302 and the second strap member is attached to the third leg portion 106 near its free end. The side release probe 298 can be selectively joined to the side release receiver 302 to close the berm wall support 370.

Figure 6:
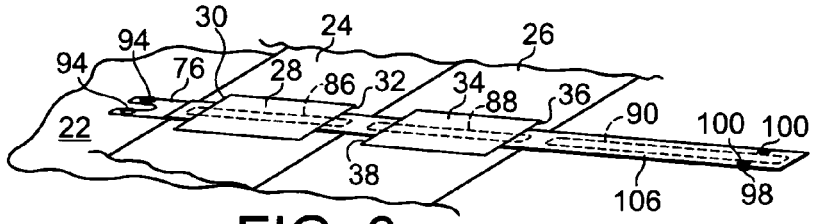
FIG. 6 is a perspective view of the containment berm wall support shown in FIG. 4 inserted into and retained within a sidewall support sleeve and within a cooperating respective skirt sleeve and showing a berm sidewall in an open let down condition.
Figure 7:
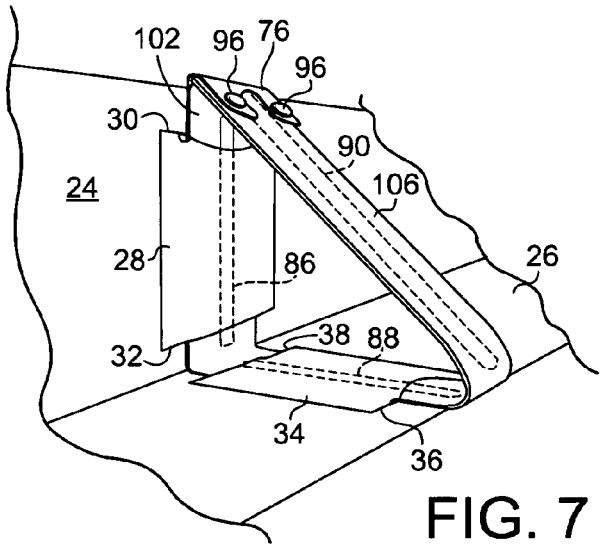
FIG. 7 is a perspective view of the containment berm wall support shown in FIG. 6 inserted into and retained within the sidewall support sleeve and the cooperating respective skirt sleeve, showing the berm sidewall in an erected condition, and showing the berm wall support in a closed condition with the flap portion located near the top of the sidewall.
Figure 8:
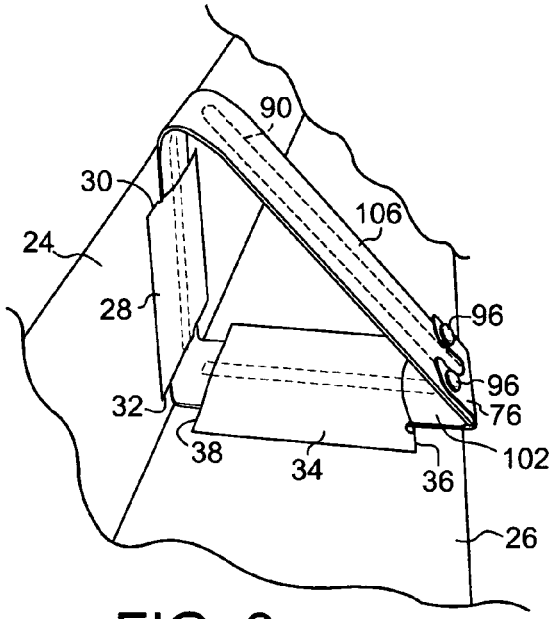
FIG. 8 is a perspective view of a containment berm wall support inserted into and retained within a sidewall support sleeve and within a cooperating respective skirt sleeve, showing a berm sidewall in an erected condition, and showing the berm wall support in a closed condition with the flap portion located near the outer edge of a sidewall skirt of the containment berm unit.

As illustrated in FIGS. 6 to 8, closure of a containment berm wall support 70 in the preferred embodiment is effected after the wall support is inserted and retained through an upper opening 30 of a sidewall support sleeve 28, through the sidewall support sleeve, out through a lower opening 32 of the sidewall support sleeve, and then through an inner opening 38 of a sidewall skirt sleeve 34, through the sidewall skirt sleeve, out through an outer opening 36 of the sidewall skirt sleeve, and folded together and closed by two snap button sockets 94 engaging two snap button studs 98, see FIGS. 7 and 8.

FIGS. 3 to 14 show closure means that may include at least one snap button socket 94 and at least one cooperating snap button stud 98; a hook and loop closure device (a hook pad 178 and a cooperating loop pad 182); cooperating closed loop endpieces 274 and 280 attached to or formed in each end of the containment berm wall support and selectively joined together by a closing pin 284 or a closing cable 292; or at least one side release buckle attached between the ends of the containment berm wall support.

Figure 5:
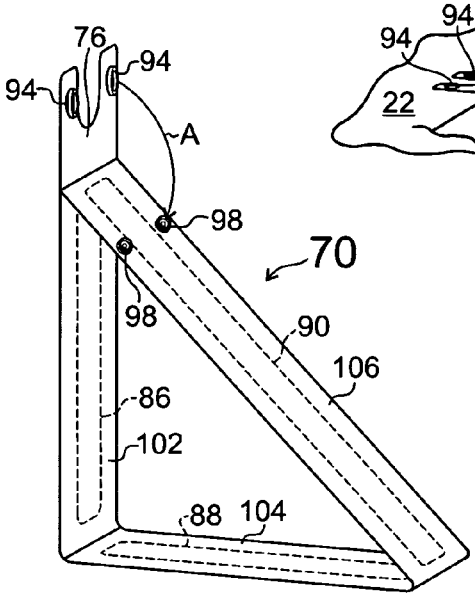
FIG. 5 is a perspective view of the containment berm wall support shown in FIG. 4 in a transitional condition between the open extended condition and a closed condition and with a curved arrow A illustrating a direction in which a fold may be made in a flap portion of the containment berm wall support to bring a snap button socket attached to the flap portion for engaging with a cooperating snap button stud attached to the main portion near the opposite end of the containment berm wall support.

In FIG. 5, arrow A shows a direction that a flap portion 76 having a snap button socket 94 attached may be folded to secure the snap button socket to a snap button stud 98 attached to a portion of the outer surface of the containment berm wall support 70.

FIG. 9 shows a containment berm support 170 which is a second embodiment of a containment berm support that differs from the first embodiment by the replacement of the flap portion 76 of the first embodiment with a differently shaped flap portion 176, the replacement flap portion having a hook pad 178 attached on its surface adjacent the intermediate stay layer 78 and by the replacement of the snap button stud 98 of the first embodiment with a loop pad 182 attached to the outer surface of the main portion 74 away from the intermediate stay layer. The hook pad 178 and the loop pad 182 can be removably pressed together and engaged to one another to close the containment berm wall support 170.

The stay layers 72, 78, 92, 172, and 272 and the endpieces 274 and 280 can be made in part from a suitable flexible material such as a coated fabric made of polyester yarn or other suitable yarn coated with a polyurethane coating, a polyvinyl chloride coating, or another coating material that will remain impervious to the transmission of contamination through the material.

Preferably the reinforcing members 86, 88, and 90 are made of generally rigid, nonconductive fiberglass rods or another suitable material such as wood, metal, or ceramic material.

The snap button sockets 94, caps 96, studs 98, and posts 100 can be made of metal or a suitable plastic or another suitable material.

The strap members 294 and 300 can be made from a common nylon webbing or another suitable strap material.

The side release probe 298 and the side release receiver 302 can be made of metal or plastic or another suitable material.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

We claim:

1. A containment berm wall support comprising a first outer stay layer having a main portion and a flap portion;

said main portion underlaying in facing opposing relationship an intermediate stay layer and secured by a joining means to said intermediate stay layer, said intermediate stay layer having a first leg portion registration window located near one end, having a second leg portion registration window located near its midpoint, and having a third leg portion registration window located near the other end;

said flap portion extending beyond said overlaying intermediate stay layer and said flap portion having at least one first closure element attached to said flap portion near its outward end on the flap portion surface adjacent said intermediate stay layer;

a first leg portion reinforcing member registered in said first leg portion registration window;

a second leg portion reinforcing member registered in said second leg portion registration window;

a third leg portion reinforcing member registered in said third leg portion registration window;

a second outer stay layer overlaying in facing opposing relationship said intermediate stay layer and overlaying said reinforcing members and secured by said joining means to said intermediate stay layer; and at least one second closure element attached to said main portion on the main portion surface away from said intermediate stay layer and located near the end of said main portion away from said flap portion.

2. A containment berm wall support according to claim 1 wherein said joining means include radio frequency welding, heat fusing, ultrasonic welding, adhesive gluing, sewing, riveting, or another suitable method of joining known in the art.

3. A containment berm wall support according to claim 1 wherein said first closure element comprises a snap button socket and said second closure element comprises a snap button stud.

4. A containment berm wall support according to claim 1 wherein said first closure element comprises a hook pad and said second closure element comprises a loop pad.

5. A containment berm wall support according to claim 1 wherein said berm wall support is photo reflective.

6. A containment berm wall support according to claim 3 wherein said berm wall support is photo reflective.

7. A containment berm wall support according to claim 4 wherein said berm wall support is photo reflective.

8. A containment berm wall support comprising a main assembly having two ends and said main assembly comprising a first outer stay layer underlaying in facing opposing relationship an intermediate stay layer and secured by a joining means to said intermediate stay layer, said intermediate stay layer having a first leg portion registration window located near one end, having a second leg portion registration window located near its midpoint, and having a third leg portion registration window located near the other end;

a first leg portion reinforcing member registered in said first leg portion registration window;

a second leg portion reinforcing member registered in said second leg portion registration window;

a third leg portion reinforcing member registered in said third leg portion registration window; and a second outer stay layer overlaying in facing opposing relationship said intermediate stay layer and overlaying said reinforcing members and secured by said joining means to said intermediate stay layer;

a first leg portion female endpiece, said female endpiece attached to one end of said main assembly, said female endpiece having a first closed loop portion and a second closed loop portion coaxial to and spaced from one another;

and a third leg portion male endpiece, said male endpiece attached to the other end of said main assembly, said male endpiece having a male closed loop portion sized to be received coaxially between said first closed loop portion and said second closed loop portion; and a closing pin for securing said male closed loop portion in position between said first closed loop portion and said second closed loop portion, said closing pin removably receivable and retainable in said loop portions when said loop portions are coaxially aligned with said male closed loop portion between said first closed loop portion and said second closed loop portion.

9. A containment berm wall support according to claim 8 wherein said joining means include radio frequency welding, heat fusing, ultrasonic welding, adhesive gluing, sewing, riveting, or another suitable method of joining known in the art.

10. A containment berm wall support according to claim 8 wherein said berm wall support is photo reflective.

11. A plurality of containment berm wall supports in combination with a containment berm unit, said containment berm unit having a liner, said liner having a floor, said floor peripherally surrounded by and connected to at least one sidewall, said sidewall having a plurality of sidewall support sleeves attached to its outward sidewall surface to receive and retain a said respective berm wall support and said sidewall having a sidewall skirt connected at the outward base of said sidewall and extending outwardly, said skirt having a plurality of skirt sleeves with each said skirt sleeve in a cooperating relationship with a respective said sidewall support sleeve to receive and retain a said respective berm wall support, wherein each said containment berm wall support comprises:

a first outer stay layer having a main portion and a flap portion;

said main portion underlaying in facing opposing relationship to an intermediate stay layer and secured by a joining means to said intermediate stay layer, said intermediate stay layer having a first leg portion registration window located near one end, having a second leg portion registration window located near its midpoint, and having a third leg portion registration window located near the other end;

said flap portion extending beyond said overlaying intermediate stay layer and said flap portion having at least one first closure element attached to said flap portion near its outward end on the flap portion surface adjacent said intermediate stay layer;

a first leg portion reinforcing member registered in said first leg portion registration window;

a second leg portion reinforcing member registered in said second leg portion registration window;

a third leg portion reinforcing member registered in said third leg portion registration window;

a second outer stay layer overlaying in facing opposing relationship said intermediate stay layer and overlaying said reinforcing members and secured by said joining means to said intermediate stay layer; and at least one second closure element attached to said main portion on the main portion surface away from said intermediate stay layer and located near the end of said main portion away from said flap portion.

12. A plurality of containment berm wall supports according to claim 11 wherein said joining means include radio frequency welding, heat fusing, ultrasonic welding, adhesive gluing, sewing, riveting, or another suitable method of joining known in the art.

13. A plurality of containment berm wall supports according to claim 11 wherein each said first closure element comprises a snap button socket and said second closure element comprises a snap button stud.

14. A plurality of containment berm wall supports according to claim 11 wherein said first closure element comprises a hook pad and said second closure element comprises a loop pad.

15. A plurality of containment berm wall supports according to claim 11 wherein each said berm wall support is photo reflective.

* * * * *